US005842369A

United States Patent [19]

Kutschker

[11] Patent Number: 5,842,369

[45] Date of Patent: Dec. 1, 1998

[54] SHEET METAL BENDING DEVICE WITH AN ECCENTRIC MEMBER FOR ADJUSTING THE BENDING CHEEK

[75] Inventor: Wolfgang Kutschker, Boeblingen, Germany

[73] Assignee: Reinhardt Maschinenbau GmbH, Sindelfingen, Germany

[21] Appl. No.: 19,775

[22] Filed: Feb. 6, 1998

Related U.S. Application Data

[63] Continuation of PCT/EP96/01885 May 7, 1996.

[30] Foreign Application Priority Data

Aug. 8, 1995 [DE] Germany ..... 195 29 126.3

[51] Int. Cl.[6] ..... B21D 5/04

[52] U.S. Cl. ..... 72/319

[58] Field of Search ..... 72/319–321, 316, 72/482.1

[56] References Cited

U.S. PATENT DOCUMENTS 5,259,231 11/1993 Kutschker ..... 72/319

FOREIGN PATENT DOCUMENTS 942 622 4/1956 Germany .

39 35 659 5/1991 Germany .

37419 2/1992 Japan ..... 72/319

*Primary Examiner*—Daniel C. Crane

*Attorney, Agent, or Firm*—Barry R. Lipsitz

[57] ABSTRACT

A sheet metal bending device comprising a machine frame, a lower cheek, an upper cheek adjustable relative to the lower cheek, and a bending cheek which is pivotable about a pivot axis fixed on the machine frame and whose distance from the pivot axis is adjustable, comprises the following features: an eccentric member for adjusting the distance of the bending cheek from its pivot axis, and an immobilizing mechanism for immobilizing the eccentric member in a predetermined angular position, the distance of the bending cheek from its pivot axis being adjustable by pivoting the bending cheek while the eccentric member is immobilized.

8 Claims, 4 Drawing Sheets

SHEET METAL BENDING DEVICE WITH AN ECCENTRIC MEMBER FOR ADJUSTING THE BENDING CHEEK

This application is a continuation of International PCT Application No. PCT/EP96/01885 filed on May 7, 1996.

The invention relates to a sheet metal bending device comprising a machine frame, a lower cheek, an upper cheek adjustable relative to the lower cheek, and a bending cheek which is pivotable about a pivot axis fixed on the machine frame and whose distance from the pivot axis is adjustable.

A device of this kind is known from DE 39 35 659 C2. With the known device it is possible to adjust the distance of the bending cheek from its pivot axis during the bending operation. This distance can, however, also be adjusted prior to commencement of a bending operation, for example, in dependence upon the thickness of the metal sheet, to a suitable constant value. A separate guiding and driving mechanism of its own is required by the known device in each case in order to bring about the adjustment of the distance of the bending cheek from its pivot axis, which does, of course, make the device as a whole complicated and elaborate.

The object of the invention is to simplify a generic device with respect to adjustment of the distance of the bending cheek from its pivot axis prior to the bending operation such that no elaborate guiding and driving mechanisms are required for this purpose, but instead the drive units provided anyhow on the device can be used to adjust this distance.

The object is accomplished in accordance with the invention by the following features:

A. an eccentric member for adjusting the distance of the bending cheek from its pivot axis;

B. an immobilizing mechanism for immobilizing the eccentric member in a predetermined angular position;

C. the distance of the bending cheek from its pivot axis being adjustable by pivoting the bending cheek while the eccentric member is immobilized.

This construction makes it possible, prior to commencement of a bending operation, to adjust the respective distance solely by pivoting the bending cheek and, therefore, in particular, a separate drive mechanism for this purpose can be dispensed with.

Figure 1:
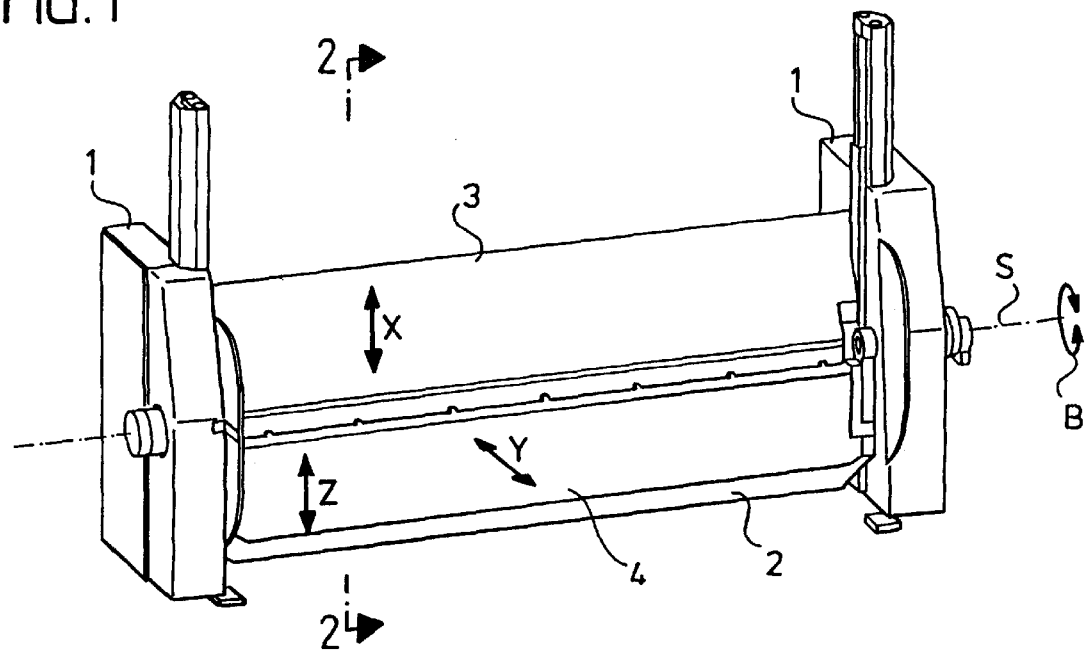
Figure 2:
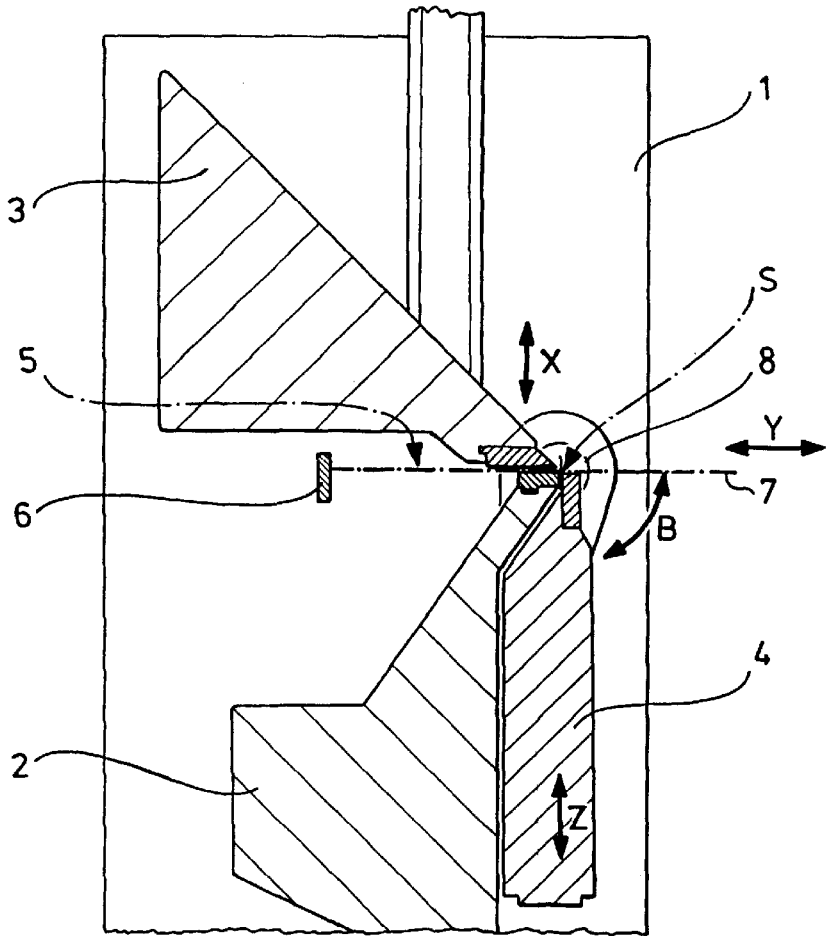
Figure 3:
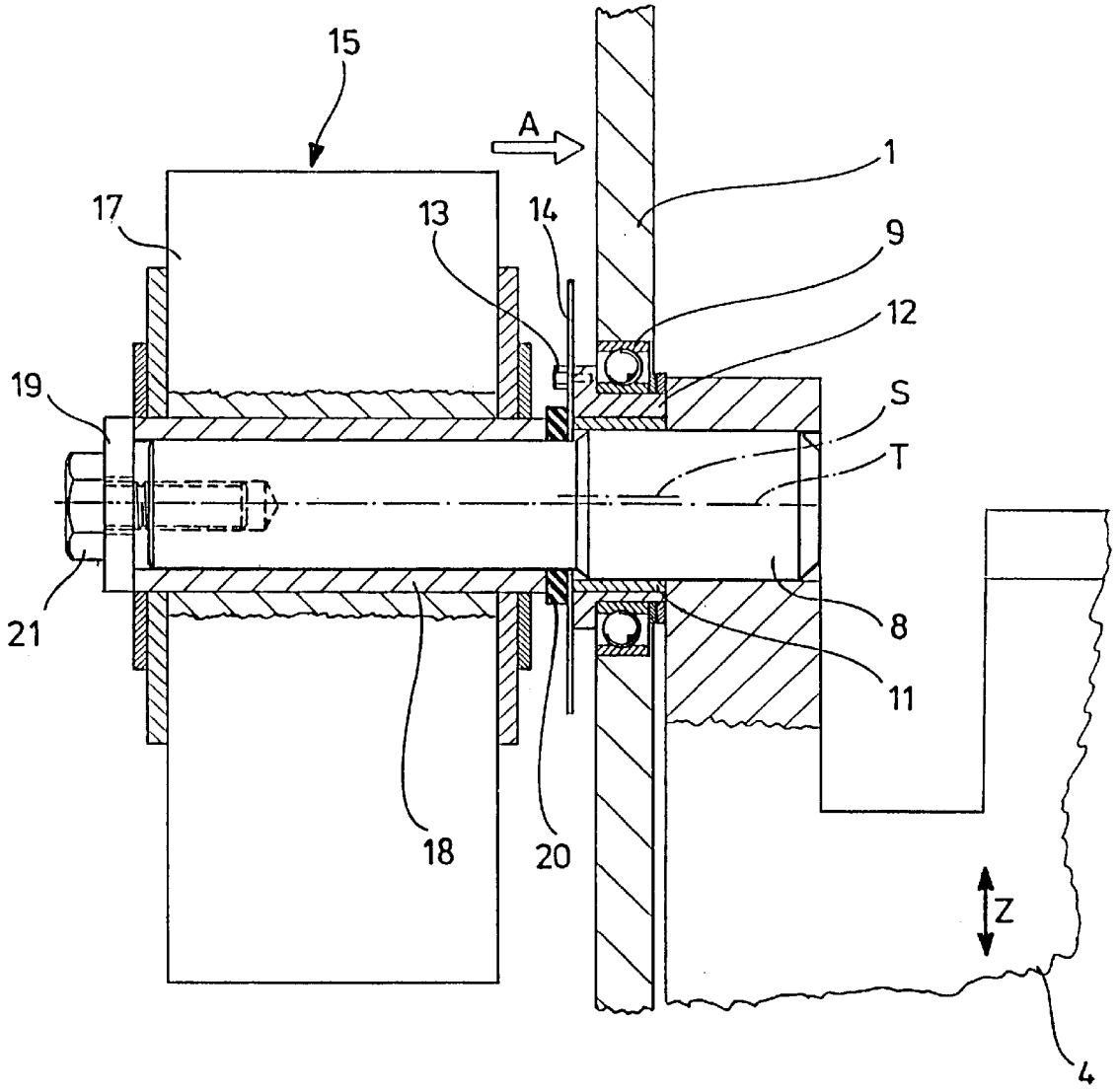
Figure 4:
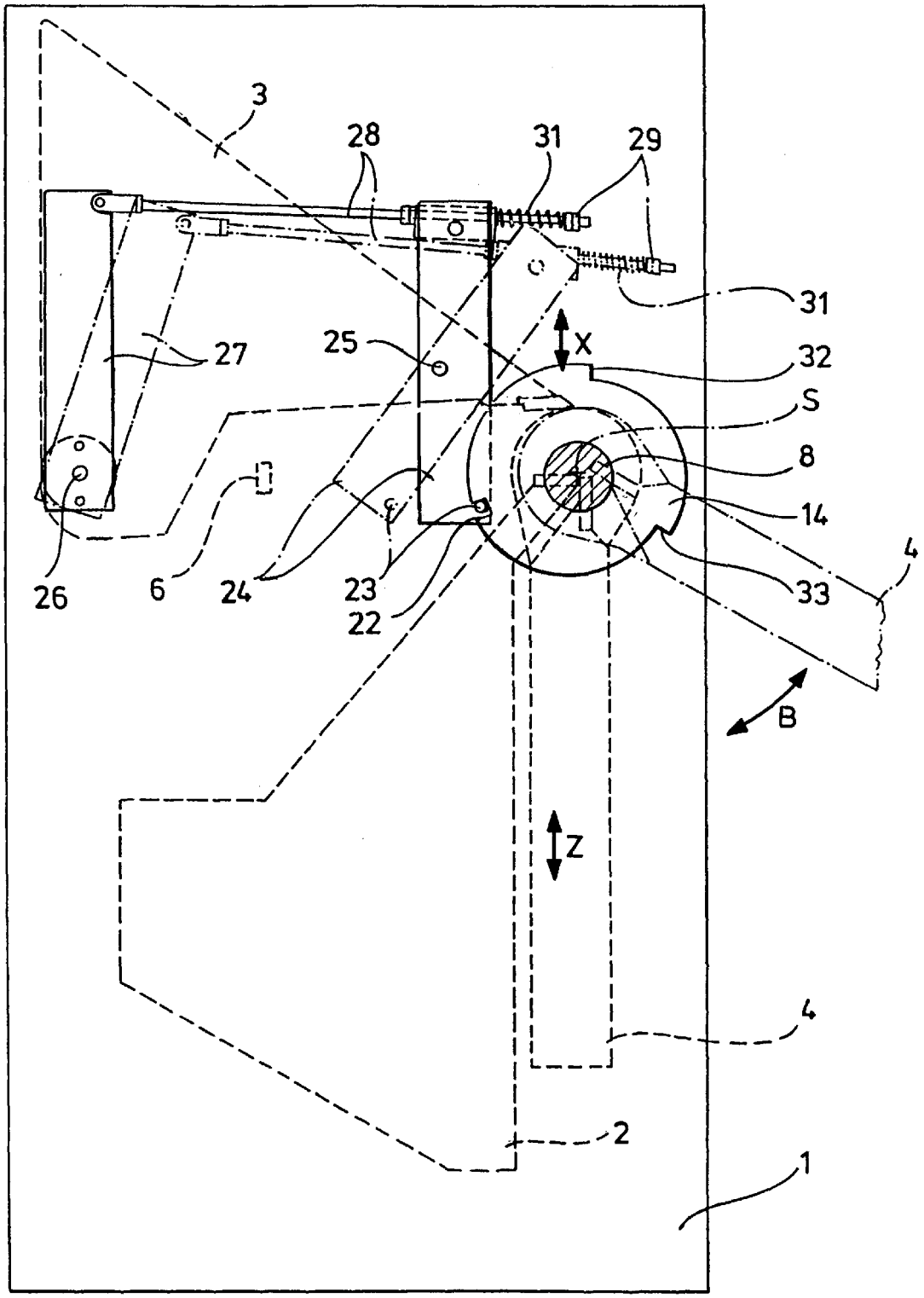

The following description of preferred embodiments of the invention serves in conjunction with the appended drawings to explain the invention in greater detail. The drawings show:

FIG. 1 a schematic, perspective view of a swivel-type bending machine;

FIG. 2 a schematic, sectional view taken along line 2—2 in FIG. 1;

FIG. 3 a partly sectional, schematic view of a preferred embodiment of the invention with eccentric adjustment of the bending cheek;

FIG. 4 a schematic view in the direction of arrow A in FIG. 3; and

Figure 5:
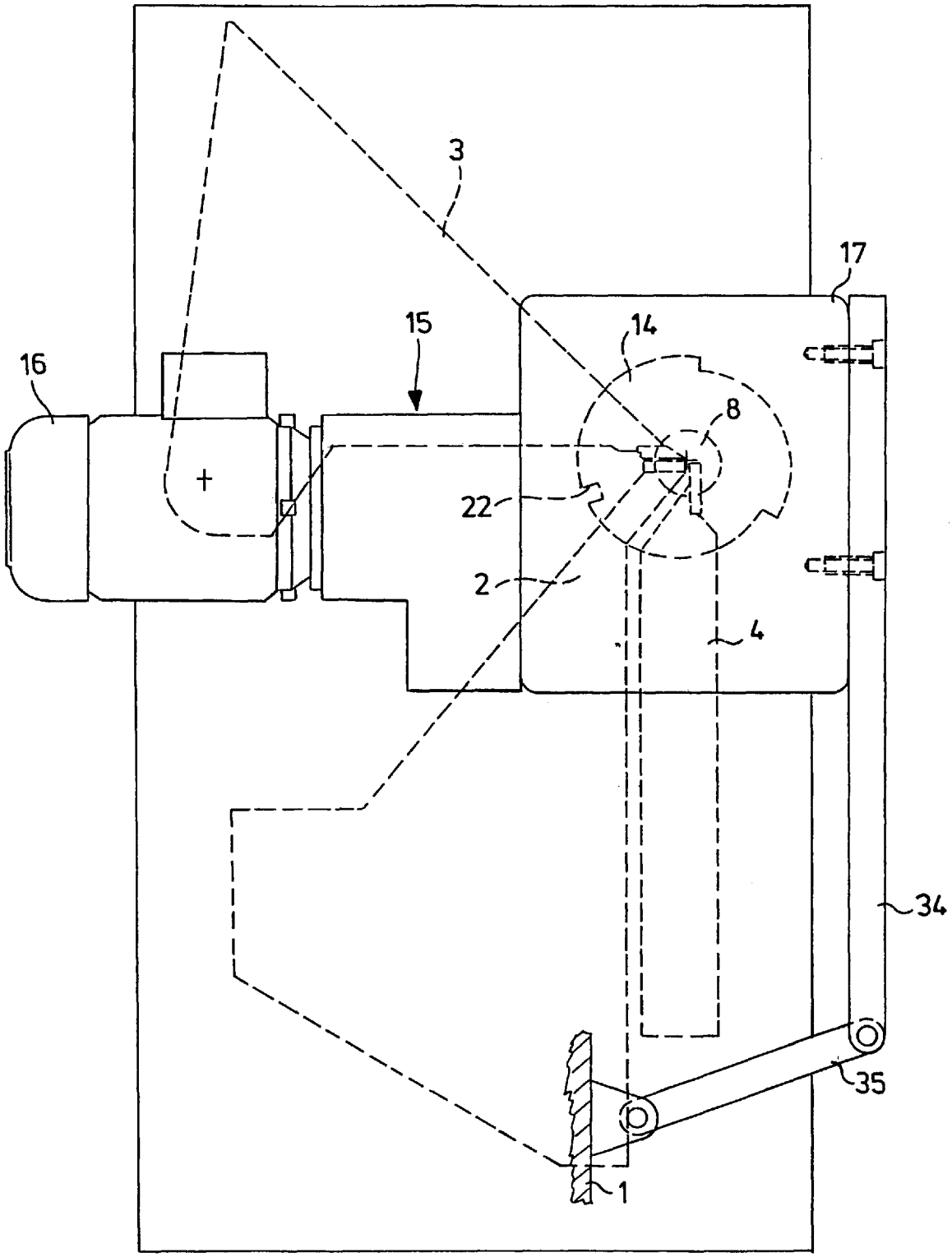

FIG. 5 the arrangement of a drive unit for the bending cheek.

FIGS. 1 and 2 show a device for bending sheet metal, also referred to as a "swivel-type bending machine". The device comprises as main components a stationary machine frame 1, a lower cheek 2, as a rule, stationary (visible, in particular, in FIG. 2), an upper cheek 3 adjustable relative to the lower cheek 2, and a bending cheek 4 pivotable back and forth in the direction of double arrow B about a pivot axis S fixed on the machine frame. The upper cheek 3 is adjustable in the direction of arrow X relative to the lower cheek 2 such that a metal sheet 5 can be pushed in between lower cheek 2 and upper cheek 3 in the direction of arrow Y and placed against a stop 6. By lowering the upper cheek 3 in the direction of arrow X, the metal sheet 5 is firmly clamped between lower cheek 2 and upper cheek 3 such that a metal sheet portion 7 projecting over lower and upper cheeks can be bent upwards by pivoting the bending cheek 4 about the pivot axis S, with a contact surface of the bending cheek 4 engaging the underside of the metal sheet portion 7.

In order to avoid crushing of the metal sheet 5 by the bending cheek 4 during this bending operation, the distance of the bending sheet 4, more precisely, the distance of its contact surface on the metal sheet portion 7, from the pivot axis S is adjustable in the direction of arrow Z. This distance is adjusted before commencement of the bending operation, for example, in dependence upon the respective thickness and the bending radius of the metal sheet 5.

With reference to an embodiment, it will be described hereinbelow how automatic adjustment of the bending cheek 4 in the direction Z can be carried out with simple means and using exclusively drive mechanisms provided anyhow on the swivel-type bending machine.

FIG. 3 shows schematically the bending cheek 4, which is mounted by means of a shaft 8 rigidly connected thereto and a rolling bearing 9 for pivotal movement (on both sides) in the machine frame 1. The shaft 8 is enclosed by a brake bushing 11 which rests with a high nonslip value on the outer side of the shaft 8 so a certain torque is required to bring about relative rotation between the shaft 8 and the brake bushing 11. The brake bushing 11 is fixedly connected on the outer side thereof to an eccentric member 12 whose outer side rotates in the rolling bearing 9. Normally, the shaft 8 and the bending cheek 4 connected thereto can thus be pivoted together with the eccentric member 12 about the pivot axis S, and the distance of the bending cheek 4 from the pivot axis S corresponds to the distance of this axis from the center axis T of the shaft 8.

The eccentric member 12 has a bore which is eccentric in relation to the pivot axis S and is penetrated by the shaft 8. The center axis of the rolling bearing 9 coincides with the pivot axis S of the bending cheek 4. As indicated in FIG. 3, the center axis T of the shaft 8 which is rigidly connected to the bending cheek 4 lies at a certain distance from the pivot axis S. This distance is variable in accordance with the angular position of the eccentric member 12 relative to the shaft 8 and thus selectively adjustable. A distance component (of, for example, a few mm) in the direction of arrow Z (FIG. 2) is, therefore, achievable by corresponding rotation of the eccentric member 12 relative to the shaft 8, (slight) adjustment of the shaft 8 and thus of the bending cheek 4 in a direction perpendicular to the drawing plane of FIG. 3 being of no account.

The eccentric member 12 is rigidly connected by screws 13 to a disc 14 so the eccentric member 12 can be adjusted relative to the shaft 8 by turning the disc 14. The adjustment of the disc 14 is carried out before commencing the bending operation by a corresponding pivotal movement of the bending cheek 4 while the disc 14 is held immovable, as will be explained in greater detail hereinbelow.

As will be apparent from FIG. 3, the shaft 8 has an extension beyond the machine frame 1 (to the left in FIG. 3) and carries there a drive unit 15, indicated only schematically, which is non-rotatably held on the machine frame in a manner which will be described hereinbelow and serves to drive the shaft 8 and hence the bending cheek 4. The drive unit 15 comprises in the conventional manner an electric motor 16 (visible in FIG. 5) and a push-on gearing 17 which is placed by means of a driven hollow shaft 18 on the extension of the shaft 8, the hollow shaft 18 being rotationally fixedly connected (via a key fit) to the extension of the shaft 8. Via a plate 19 and a screw 21 which is screwed into the extension of the shaft 8, a ring 20 of elastomeric material is pressed with an axial bias against the disc 14 so that in addition to the self-locking between shaft 8 and eccentric member 12 brought about by the brake bushing 11, a further frictional connection is established between these two parts, which results in an additional taking-along effect between eccentric member 12 and shaft 8.

The disc 14 is part of an immobilizing mechanism for the eccentric member 12 relative to the shaft 8 so that, as mentioned above, when the eccentric member 12 is immobilized and the shaft 8 is rotated, with the self-locking between eccentric member 12 and shaft 8 thereby being overcome, a relative adjustment between these two parts and hence an adjustment of the distance of the bending cheek 4 from its pivot axis S is possible.

The disc 14 has on its circumferential edge, as shown in FIG. 4, a notch 22 which can be penetrated by a retaining pin 23 which is held stationarily on the machine frame 1 so that the disc 14 is thereby prevented from rotational movement. The retaining pin 23 which is a further part of the immobilizing mechanism projects (perpendicularly to the drawing plane of FIG. 4) from a lever 24 which is pivotable about an axis of rotation 25 fixed on the machine frame. FIG. 4 shows in solid lines that position of the lever 24 in which the retaining pin 23 penetrates the notch 22 and thereby fixes the disc 14. In the position of the lever 24 shown in dot-and-dash lines in FIG. 4, the retaining pin 23 is disengaged from the notch 22 so the disc 14 and hence the eccentric member 12 and also the shaft 8 with bending cheek 4 can rotate jointly.

In FIG. 4, the bending cheek 4 is initially located in the dashed position oriented vertically downwards, and the disc 14 is fixed by the retaining pin 23 penetrating the notch 22. When the bending cheek 4 is pivoted in the counterclockwise direction out of this zero or initial position in the direction of arrow B, owing to the eccentric member 12 which is likewise immobilized via the disc 14, a relative movement between the eccentric member 12 and the shaft 8 and hence a desired adjustment of the distance between the bending cheek 4 and the pivot axis S takes place.

The introduction of the retaining pin 23 into the notch 22 (and vice-versa also the disengagement of the pin 23 from the notch 22) can be carried out with the lever 24 or also in a different way, in principle, manually, and, if desired, the notch 22 can also be located at a different place from that which is illustrated. FIG. 4 shows an arrangement which always permits automatic insertion of the retaining pin 23 into the notch 22 when the bending cheek 4 is located in its downwardly oriented initial position.

The upper cheek 3, which is also shown in dashed lines in FIG. 4, is pivotable (via a drive motor which is not illustrated) about an axis of rotation 26 fixed on the machine frame so that its end facing the lower cheek 2 (essentially in the direction of arrow X shown in FIG. 2) can be lifted off the lower cheek 2. Rigidly connected to the upper cheek 3 is an arm 27 which moves accordingly along with the pivotal movements of the upper cheek. Articulatedly connected to the arm 27 is one end of a rod 28 which penetrates a relatively wide bore in the lever 24. Arranged between a nut 29 provided at the other end of the rod 28 and the edge (located at the right in FIG. 4) of the lever 24 is a helical spring 31 which biases the lever 24 in the counterclockwise direction (in FIG. 4). The connection between lever 24 and rod 28 is thus of such an elastic kind that the lever 24 can execute a limited free movement (in the clockwise direction) relative to the rod 28 and hence to the arm 27.

When bending cheek 4 and disc 14 assume their initial position shown in FIG. 4 and the upper cheek 3 is raised, the retaining pin 23 moves via the arm 27, the rod 28 and the lever 24 into the notch 22, whereby the disc 14 is immobilized. It is not necessary to act manually on the retaining pin 23 as the movement of the retaining pin 23 takes place via the upper cheek 3 and its drive motor.

The arrangement in FIG. 4 is of such configuration that even upon partial rearward pivotal movement of the upper cheek 3 in the direction of its closing position, the retaining pin 23 disengages from the notch 22 again, i.e., a long time before the end of the upper cheek 3 rests firmly again on the lower cheek 2 and so a metal sheet which is to be bent can still be introduced between lower cheek 2 and upper cheek 3 in accordance with FIG. 2 beforehand.

It can happen that the disc 14 does not assume the position shown in FIG. 4 relative to the downwardly oriented bending cheek 4 so the notch 22 lies at a different place and, therefore, the retaining pin 23 cannot penetrate it. To ensure that the retaining pin 23 can be automatically introduced into the notch 22 in each relative position of the disc 14 to the shaft 8, the following provisions are made: The disc 14 has on its circumferential edge aside from the notch 22 two steps 32, 33 which are arranged at angular spacings of 120° in relation to each other and to the notch 22. The circumferential edge section between the notch 22 and the step 32 is circular, while the circumferential edge sections between the steps 32, 33 and between the step 33 and the notch 22 have approximately the shape of involutes, as will be apparent from the illustration in FIG. 4.

If, at the beginning of the adjustment of the distance of the bending cheek 4 from its pivot axis S, the disc 14 is in a position relative to the bending cheek 4 which differs from that shown in FIG. 4, the following procedure is carried out: The upper cheek 3 is brought into the illustrated position in which it is lifted off the lower cheek 2. The retaining pin 23 may come to rest at any point on the circumferential edge of the disc 14, and the spring 31 acts as elastic compensation if the pivotal movement of the lever 24 cannot complete its full movement owing to failure of the retaining pin 23 to radially penetrate the notch 22 or one of the steps 32, 33. The bending cheek is now pivoted in the counterclockwise direction in the direction of arrow B through somewhat more than 120° via the electric motor 16 (FIG. 5) driving the bending cheek 4. The bending cheek 4 is then returned to its initial position, during which the disc 14 is immobilized by the retaining pin 23 engaging one of the steps 32, 33 or the notch 22, and the bending cheek 4 is rotated through a certain angle relative to the disc 14, more precisely, depending on the previous relative position of bending cheek 4 and disc 14. (The spring 31 allows the compulsory engagement of the retaining pin 23 in the steps 32, 33 or the notch 22 beforehand, if the retaining pin 23 should first contact a circumferential edge section of larger radius.)

This procedure of pivoting the bending cheek 4 back and forth through somewhat more than 120° is carried out for a total of three times. It is thereby ensured that at the latest after the third pivoting back and forth of the bending cheek 4, the retaining pin 23 is safely inserted in the notch 22 and the arrangement assumes the configuration shown in FIG. 4. By renewed pivoting of the bending cheek 4, while the eccentric member 12 is immobilized by the retaining pin 23, the desired distance of the bending cheek 4 from its pivot axis S can now be adjusted.

The described automatic locking of the disc 14 with the retaining pin 23 occurs purely mechanically without the necessity for a separate, for example, electronic or electrooptical sensor means with which the respective angular positions of the disc 14 and the shaft 8 are sensed.

FIG. 5 shows the mounting of the electric motor 16 for driving the shaft 8 of the bending cheek 4 with the push-on gearing 17 on the machine frame 1. This mounting must be articulated as the motor 16 is pushed via the push-on gearing 17 directly onto the shaft 8 and hence follows the eccentric rotary movements of this shaft 8 brought about by the eccentric member 12. This eccentric movement takes place in the drawing plane of FIG. 5. Accordingly, the lever means must also develop its articulation in this plane and, for this purpose, it comprises two levers lying in this plane, namely a first lever 34 which is rigidly connected to the push-on gearing 17 and to which there is articulatedly connected a lever 35 which, in turn, is articulatedly connected to the machine frame 1.

In the embodiment of the invention illustrated and described herein, the eccentric member 12 encloses the shaft 8 of the bending cheek 4 and is rotatably mounted with the rolling bearing 9 in the machine frame. In principle, however, other arrangements of the eccentric member for adjustment of the distance of the bending cheek from its pivot axis are also possible if solely with the eccentric member immobilized, the distance of the bending cheek from its pivot axis is adjustable by pivoting the bending cheek.

Furthermore, in the illustrated embodiment the retaining pin 23 of the immobilizing mechanism is actuated by movement of the upper cheek 3. In principle, however, other driven parts of the machine which are provided anyhow could also be used for this purpose, for example, a lower cheek which is optionally adjustable.

In the illustrated embodiment, the fixing of the immobilizing mechanism consisting essentially of the disc 14 with the notch 22 and the movable retaining pin 23 is brought about by the engagement of the retaining pin 23 in the notch 22. Here, too, modifications are conceivable, for example, use of a clamping mechanism with which the disc 14 forming part of the immobilizing mechanism can be firmly clamped in a predetermined angular position.

The construction and arrangement of the eccentric member 12 illustrated in FIG. 3 is also provided mirror-symmetrically on the opposite side of the bending cheek 4 on the machine frame 1, more precisely, including the immobilizing mechanism, but without drive unit 15, which is only necessary on one side of the device.

The sheet metal bending device described herein is preferably equipped with a programmable control means, for example, a CNC control, with the aid of which, in particular, also the immobilizing mechanism of the disc 14 and thus of the eccentric member 12 is actuated and the distance of the bending cheek 4 from the pivot axis S is automatically adjusted in the manner explained herein.

I claim:

1. Device for bending a metal sheet comprising:

a machine frame, a lower cheek, an upper cheek adjustable relative to said lower cheek so as to position said cheeks to grip said metal sheet, a bending cheek pivotable about a pivot axis fixed on said machine frame for bending a portion of said gripped metal sheet, an eccentric member adapted to be moveable in various angular positions for adjusting the distance of said bending cheek from its pivot axis; and an immobilizing mechanism for immobilizing said eccentric member in a predetermined angular position;

wherein the distance of said bending cheek from its pivot axis is adjustable by pivoting said bending cheek while said eccentric member is immobilized.

2. Device as defined in claim 1, wherein said eccentric member encloses a shaft carrying said bending cheek and is mounted on its outer side with a rotary bearing for rotation in said machine frame.

3. Device as defined in claim 2, wherein said eccentric member is arranged in a self-locking manner on said shaft of said bending cheek.

4. Device as defined in claim 1, wherein said immobilizing mechanism is firmly clampable in the predetermined angular position by a clamping device.

5. Device as defined in claim 1, wherein said immobilizing mechanism is lockable in the predetermined angular position by a detent device.

6. Device as defined in claim 1, wherein said immobilizing mechanism is actuatable by the movement of said upper cheek.

7. Device as defined in claim 2, wherein a drive unit of said bending cheek is arranged on a shaft of said bending cheek, said shaft being adjustable by said eccentric member.

8. Device as defined in claim 7, wherein said drive unit is fixed on said machine frame by a lever means.

* * * * *